US009771754B2

(12) United States Patent
Lewan et al.

(10) Patent No.: US 9,771,754 B2
(45) Date of Patent: Sep. 26, 2017

(54) FLEXIBLE SEALS FOR INSULATED DOORS

(71) Applicants: Derek Lewan, Dubuque, IA (US); Nicholas J. Casey, Cascade, IA (US); Rodney Kern, Dubuque, IA (US); William W. Hoerner, Dubuque, IA (US)

(72) Inventors: Derek Lewan, Dubuque, IA (US); Nicholas J. Casey, Cascade, IA (US); Rodney Kern, Dubuque, IA (US); William W. Hoerner, Dubuque, IA (US)

(73) Assignee: RITE-HITE HOLDING CORPORATION, Milwaukee, WI (US)

( * ) Notice: Subject to any disclaimer, the term of this patent is extended or adjusted under 35 U.S.C. 154(b) by 0 days.

(21) Appl. No.: 14/936,091

(22) Filed: Nov. 9, 2015

(65) Prior Publication Data

US 2017/0130522 A1 May 11, 2017

(51) Int. Cl.

| | |
|---|---|
| ***E06B 7/22*** | (2006.01) |
| ***F25D 23/02*** | (2006.01) |
| ***E06B 3/46*** | (2006.01) |
| ***E06B 7/23*** | (2006.01) |

(52) U.S. Cl.

CPC ..... *E06B 7/22* (2013.01); *E06B 3/4636* (2013.01); *E06B 7/2307* (2013.01); *E06B 7/2309* (2013.01); *F25D 23/021* (2013.01); *F25D 23/028* (2013.01); *E05Y 2900/102* (2013.01)

(58) Field of Classification Search

CPC ..... E06B 7/22; F25D 23/021; F25D 23/028; E05Y 2900/102

USPC ..... 49/499.1, 500.1

See application file for complete search history.

(56) References Cited

U.S. PATENT DOCUMENTS

| | | | | |
|---|---|---|---|---|
| 712,240 A | | 10/1902 | Barnes et al. | |
| 1,452,703 A | | 4/1923 | Pollard | |
| 2,230,985 A | * | 2/1941 | Gail | E06B 7/2318 49/493.1 |
| 2,891,289 A | * | 6/1959 | Guilbert, Jr. | E06B 7/36 49/493.1 |
| 3,159,524 A | * | 12/1964 | Cantabene | F02K 9/84 156/250 |

(Continued)

FOREIGN PATENT DOCUMENTS

| | | |
|---|---|---|
| CH | 658295 | 10/1986 |
| FR | 2422807 | 11/1979 |

(Continued)

OTHER PUBLICATIONS

International Searching Authority, "International Search Report and Written Opinion," issued in connection with PCT application No. PCT/US2016/060946, mailed Apr. 6, 2017, 19 pages.

*Primary Examiner* — Jerry Redman

(74) *Attorney, Agent, or Firm* — Hanley, Flight & Zimmerman, LLC

(57) ABSTRACT

Example seals for insulated doors are disclosed. An example seal for a door includes a first mounting rail and a second mounting rail spaced apart from the first mounting rail. The example seal further includes a flexible sheet extending between the first mounting rail and the second mounting rail. The flexible sheet is to be biased away from the first and second mounting rails to sealingly engage the door when the door is in a closed position.

24 Claims, 7 Drawing Sheets

(56) References Cited

U.S. PATENT DOCUMENTS

| | | | | |
|---|---|---|---|---|
| 3,254,453 | A | 6/1966 | Dennis | |
| 3,284,957 | A * | 11/1966 | Landis | B61D 19/00 49/493.1 |
| 3,411,246 | A * | 11/1968 | Miller | E06B 7/28 49/489.1 |
| 3,869,873 | A | 3/1975 | Thomas | |
| 5,566,505 | A * | 10/1996 | Kamezaki | E05D 15/1021 49/209 |
| 5,899,463 | A * | 5/1999 | Koch | B64D 29/00 277/634 |
| 5,953,206 | A * | 9/1999 | Jondrow | G06F 1/182 361/679.26 |
| 6,397,919 | B1 | 6/2002 | Lamsfuss | |
| 6,484,447 | B1 * | 11/2002 | Snyder | E06B 3/485 160/40 |
| 7,323,236 | B2 * | 1/2008 | Dexheimer | B60R 13/02 112/418 |
| 7,578,097 | B2 | 8/2009 | Dondlinger et al. | |
| 8,344,293 | B1 * | 1/2013 | McCabe | F16L 53/008 219/482 |
| 8,752,335 | B2 | 6/2014 | Hoffmann | |
| 8,915,020 | B2 * | 12/2014 | Sauter | E06B 7/2318 187/400 |
| 2004/0134128 | A1 | 7/2004 | Berry et al. | |
| 2005/0028946 | A1 * | 2/2005 | Weishar | E05D 15/54 160/214 |
| 2005/0060937 | A1 * | 3/2005 | Dondlinger | E06B 7/2318 49/118 |
| 2005/0086868 | A1 | 4/2005 | Santelli, Jr. | |
| 2005/0201088 | A1 * | 9/2005 | Stach | F21V 23/026 362/225 |
| 2007/0022663 | A1 | 2/2007 | Faflek et al. | |
| 2007/0084126 | A1 | 4/2007 | Hautmann et al. | |
| 2008/0110580 | A1 | 5/2008 | Hoerner et al. | |
| 2010/0132264 | A1 | 6/2010 | Campbell et al. | |
| 2016/0198525 | A1 * | 7/2016 | Dudar | H05B 1/0236 219/203 |

FOREIGN PATENT DOCUMENTS

| | | |
|---|---|---|
| GB | 1537805 | 1/1979 |
| NL | 134739 | 8/1972 |
| NL | 7608393 | 1/1978 |
| WO | 2005033460 | 4/2005 |

* cited by examiner

FLEXIBLE SEALS FOR INSULATED DOORS

FIELD OF THE DISCLOSURE

This disclosure relates generally to insulated doors and, more particularly, to flexible seals for insulated doors.

BACKGROUND

Horizontally sliding doors often include one or more door panels that are suspended by carriages that travel along an overhead track. To open and close the door, the carriages move the door panels in a generally horizontal direction in front of the opening of a doorway. The movement of the panels may be powered or manually operated.

Sliding doors are often used to provide access to cold-storage rooms or lockers, which are refrigerated areas in a building that are commonly used for storing perishable foods. Many refrigerated or freezer rooms are large enough for forklifts and other material handling equipment to enter and move large quantities of products in and out of the room. Access to the room is often through a power actuated insulated door that separates the room from the rest of the building. Sliding doors are often used to close off a refrigerated room because sliding panels are relatively easy to make thick with insulation to reduce the cooling load on the room. However, refrigerated rooms may have other types of doors such as swinging doors, roll-up doors, bi-fold doors, or overhead-storing doors. Regardless of the type of door applied to a refrigerated room opening, ineffectively sealing the edges around the door panels can create cooling losses and promote frost buildup in certain areas of the door.

Figure 1:
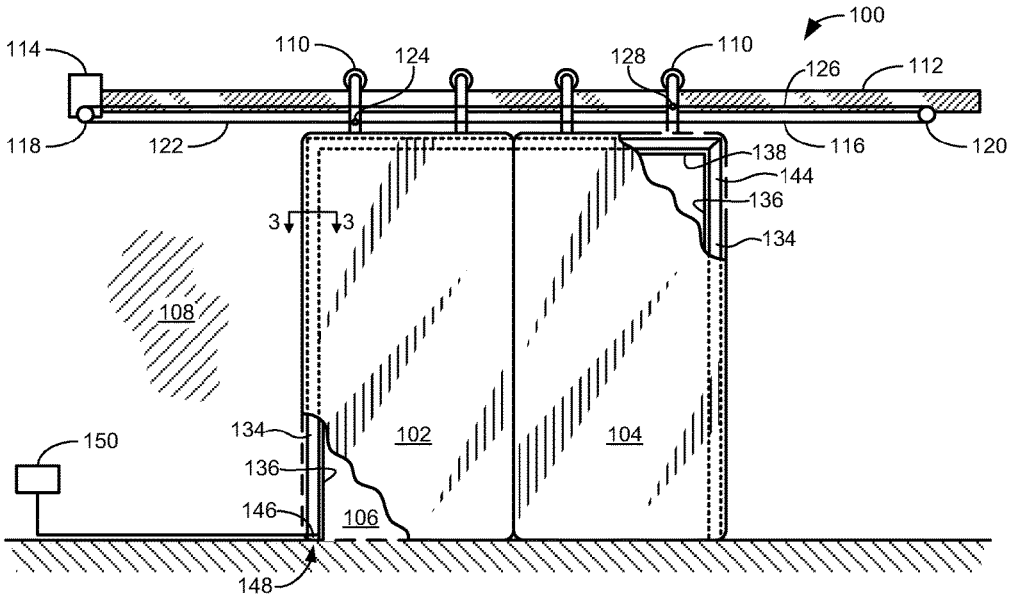
FIG. 1 illustrates an example door implemented in accordance with the teachings of this disclosure with door panels in a closed position.

The figures are not to scale. Instead, to clarify multiple layers and regions, the thickness of the layers may be enlarged in the drawings. Wherever possible, the same reference numbers will be used throughout the drawing(s) and accompanying written description to refer to the same or like parts. As used in this patent, stating that any part (e.g., a layer, film, area, or plate) is in any way positioned on (e.g., positioned on, located on, disposed on, or formed on, etc.) another part, means that the referenced part is either in contact with the other part, or that the referenced part is above the other part with one or more intermediate part(s) located therebetween. Stating that any part is in contact with another part means that there is no intermediate part between the two parts.

DETAILED DESCRIPTION

Sliding doors (and/or other types of doors) used to separate cold freezer environments from warmer areas often include a seal mounted around the door frame to span a gap between the wall holding the door frame and the path along which the sliding doors translate. As a result, the door panels slide across the seal as the door panels open or close. The engagement between the door panels and the seal reduces the leakage of air between the refrigerated area on one side of the door and a warmer area on the other side. There are several challenges to achieving reliable sealing engagement between the seal and the door panels. For example, some doors are built to withstand impacts without causing significant damage to the door panels and/or the associated track and guidance system. In some examples, the effect of impacts on a door may be mitigated by providing the door with some give or positional freedom relative to a direction passing through the doorway over which the door closes. As a result, the door panels may not be in the exact same position each time they open and close such that the gap to be closed off by the seal may vary with each cycle of the door. Thus, while the seal may be in sealing engagement with the door panels at one point in time, there may be a space between the seal and the door panels at another time. Another challenge of door seals for refrigerated rooms is the formation of frost on the door, on the seal, and/or inside the seal. Such frost may have a detrimental effect upon the sealing ability of the seal.

To resolve the concern of a variably positioned door panel and/or the formation of frost, some doors include inflatable seals that are filled with heated air. The air causes the seal to inflate and span the distance between the wall and the door panel to properly engage the door panel regardless of the particular position of the door panel. Additionally, the air may be heated to reduce the likelihood of frost build up. While blowing heated air through a seal may resolve the above issues, operating such a system can be relatively expensive and the components of a blower, a heater, and ducting can take up space and require frequent maintenance.

Another solution to variably positioned door panels involves the use of a resilient foam or other material within the seal that expands to engage the surface of the door panels. Furthermore, the insulative capacity of the foam may serve to reduce the likelihood of the formation of frost. However, many resilient foam materials may lose their flexibility by setting and becoming rigid when exposed to cold temperatures (e.g., the temperature inside a refrigerated room). Thus, when such foam insulation is compressed by a door panel in a closed position for extended periods of time and subject to the cold temperatures of a refrigerated area closed off by the door panels, the foam insulation may set in its compressed form such that it will be unable to expand or move to engage the door panel if the position of the panel moves after opening and closing again.

Examples disclosed herein overcome these challenges with a seal mounted to a wall that includes a flexible sheet that is biased outwards towards the door panel via resilient insulation lining the flexible sheet. In some examples, the seal includes self-regulating heat tape within an interior cavity of the seal to heat the air within the cavity and keeps the insulation sufficiently warm to allow full flexibility despite the cold external temperature associated with a refrigerated room.

More particularly, an example seal for a door is disclosed that includes a first mounting rail and a second mounting rail spaced apart from the first mounting rail. The example seal further includes a flexible sheet extending between the first mounting rail and the second mounting rail. The flexible sheet is to be biased away from the first and second mounting rails to sealingly engage with the door when the door is in a closed position.

Another example seal for a door includes a flexible sheet having a first edge and a second edge opposite the first edge. The first edge is to be coupled to a wall adjacent to a doorway associated with the door and the second edge is to be coupled to the wall spaced apart from the first edge to define an enclosed area. The example door further includes insulation to line an inside surface of the flexible sheet facing the wall. The insulation is to bias the flexible sheet away from the wall and into a path of a door panel of the door to sealingly engage the door panel when the door panel is in a closed position.

Another example seal for a door includes a wall mount and a flexible sheet having a first edge to be secured to the wall mount and a second edge to be secured to the wall mount. The flexible sheet and the wall mount define an internal cavity. The example seal further includes a foam lining affixed to an inner surface of the flexible sheet. The foam lining is to bias the flexible sheet away from the wall mount to sealingly engage the door when the door is in a closed position. The example door also includes heat tape disposed within the internal cavity to heat the internal cavity and the foam lining.

Figure 2:
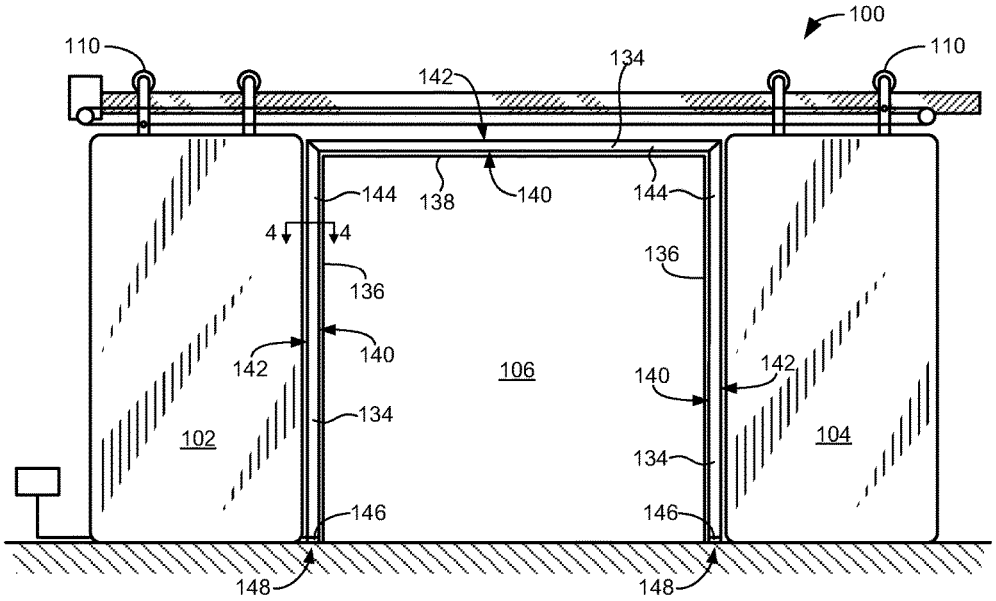
FIG. 2 illustrates the example door of FIG. 1 with the door panels in a fully open position.

FIGS. 1-2 show an example door 100 implementing the teachings of this disclosure. In the illustrated example of FIG. 1, the door 100 includes two translating door panels 102, 104 that are in a closed position to block a doorway 106 in a wall 108. In the illustrated example of FIG. 2, the door panels 102, 104 are in a fully open position to unblock the doorway 106.

While the illustrated example shows two horizontally translating door panels, the teachings of this disclosure may be applied to other types and/or configurations of doors. For example, the teachings of this disclosure may be applied to doors with only one panel or doors with more than two panels. Further, the teachings of this disclosure may be applied to vertically translating doors (e.g., rollup doors, overhead storage doors, etc.), pivoting doors, and/or any other type of door. Further still, the teachings of this disclosure may be applied to flexible doors (e.g., made of fabric) or rigid doors (e.g., made of fiberglass, rigid foam, metal, etc.). However, for purposes of explanation, the teachings of this disclosure will be described with reference to the example door 100 of FIGS. 1 and 2.

In the illustrated example, panels 102 and 104 are suspended from panel carriers 110 that can roll, slide, or otherwise travel along an overhead track 112. In some examples, the door panels 102, 104 of the door 100 are moved between a closed position (FIG. 1) and an open position (FIG. 2) by a drive unit 114. In some such examples, the drive unit 114 includes a roller chain 116 supported between a motor-driven sprocket 118 and an idler sprocket 120. As shown in the illustrated example, a lower portion 122 of the chain 116 is coupled to one of the panel carriers 110 associated with the first door panel 102 via a fastener 124 while an upper portion 126 of the chain 116 is coupled to one of the panel carriers 110 associated with the second door panel 104 via another fastener 128. In this manner, the driven rotation of the sprocket 118 and corresponding movement of the chain 116 determines whether the door panels 102, 104 move toward each other to close the door 100 or move apart to open the door 100. In some examples, the door 100 may be manually operated and/or the drive unit 114 is provided with a manual override.

In some examples, the door 100 serves to separate one area within a building from another. More particularly, in some examples, a first area 318 (FIG. 3) on one side of the door 100 corresponds to a refrigerated room or other area that is intended to be maintained at a temperature different than a second area 320 (FIG. 3) on the other side of the door 100. That is, in some examples, the first area 318 is maintained at a cooler temperature than the second area 320. However, in other examples, the first area 318 may be maintained at a warmer temperature than the second area 320 (e.g., the second area 320 corresponds to a refrigerated room). Further, in other examples, the temperatures of the first and second areas 318, 320 may be approximately the same.

In some examples, the door panels 102, 104 are made of and/or contain thermally insulative materials to reduce heat transfer between the first and second areas 318, 320 on either side of the door 100. For example, the door panels 102, 104 may be made of a thermal insulating foam core encased in a protective cover. In other examples, the door panels 102, 104 may have a metal skin or outer structure that is filled with insulation. In other examples, the door panels 102, 104 may be formed of two flexible sheets with insulation pads disposed therebetween. Other panel structures and/or materials may additionally or alternatively be used.

In the illustrated example, the door panels 102, 104 are spaced a distance from the wall 108 to enable their movement between opened and closed positions. As a result, there may be a gap between the door panels 102, 104 and the wall 108 when the door 100 is closed. Air may pass through the gap between the areas 318, 320 on either side of the door 100. Accordingly, in the illustrated example of FIGS. 1 and 2, the door 100 is provided with a seal 134 that extends along lateral edges 136 and/or an upper edge 138 of the doorway 106. The example seal 134 serves to close off the gap between the door panels 102, 104 and the wall 108 to reduce (e.g., prevent) leakage of air between either side of the door 100 when the door 100 is closed.

Figure 3:
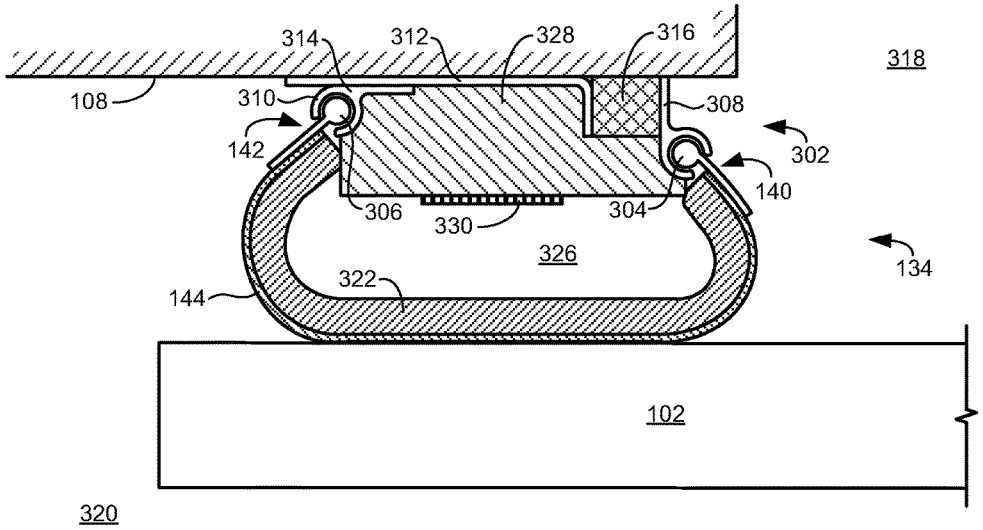
FIG. 3 is a cross-sectional view of the example seal of FIGS. 1 and 2 taken along line 3-3 of FIG. 1.
Figure 4:
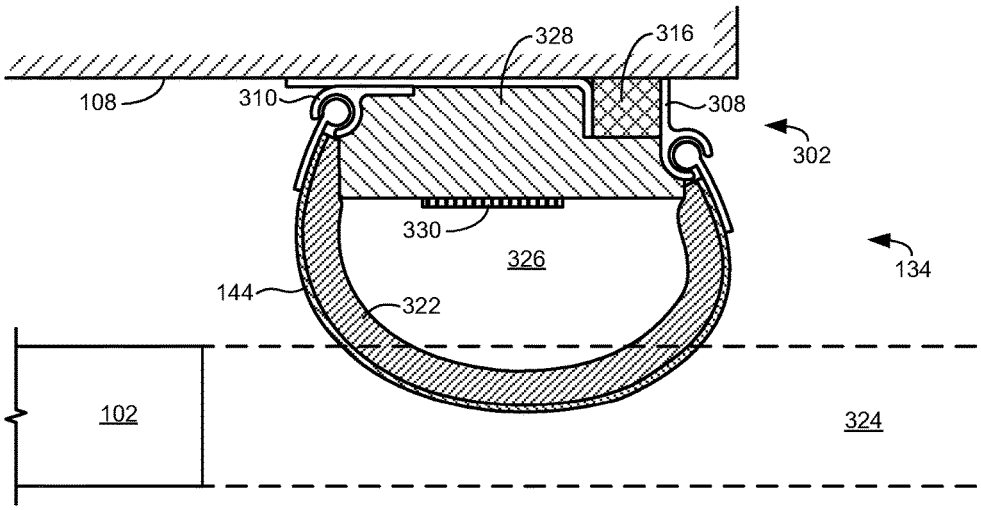
FIG. 4 is a cross-sectional view of the example seal of FIGS. 1 and 2 taken along line 4-4 of FIG. 2.

As described more fully below in connection with FIGS. 3 and 4, the example seal 134 forms an elongate tubular structure defined by opposing edges 140, 142 of a flexible sheet 144 coupled to a wall mount 302 (FIG. 3). In some examples, the flexible sheet is a tough flexible fabric such as, for example urethane coated polyester. In some examples, the wall mount 302 is attached to the wall 108 and extends adjacent the lateral edges 136 and upper edge 138 of the doorway 106. In some examples, the flexible sheet 144 is biased away from the wall mount 302 (and the wall 108) into a path of the door panels 102, 104 to facilitate sealing engagement with the door panels 102, 104 when they are in a closed position or otherwise positioned in front of the seal 134 (e.g., in a partially closed position). That is, the outward biasing of the flexible sheet 144 enables the seal 134 to close off the gap between the wall 108 and the door panels 102, 104.

In some examples, the flexible sheet 144 is biased outward by resilient insulation 322 lining an inner surface of the flexible sheet 144. In some examples, the insulation 322 is made of a resilient foam that may be compressed and/or bend in response to the door panels 102, 104 coming into contact with the seal 134, but will return to its original expanded form to bias the flexible sheet 144 into the path of the door panels 102, 104 when the door panels 102, 104 are clear of the seal 134 (e.g., in the fully open position of FIG. 2). The flexible sheet 144 is biased outward in this manner. Thus, the seal 134 can expand to fill wide and/or irregular gaps between the wall 108 and the door panels 102, 104. This is beneficial for doors that may not close to the same position each time due to, for example, inaccuracies in the drive and/or guidance system of the door and/or doors provided with some give or positional freedom to allow for impacts on the door.

Inasmuch as the door 100 of the illustrated examples is intended to close off a refrigerated room, at least one side of the seal 134 may be subject to relatively cold temperatures. Such cold temperatures may deleteriously impact the resilience of the insulation 322 intended to bias the flexible sheet 144. That is, many types of resilient foam insulation materials may set or become rigid when exposed to cold temperatures for extended periods of time. In the illustrated example, to keep the refrigerated room cold, the door panels 102, 104 are in the closed position most of the time such that the resilient insulation will be in a compressed state for extended periods of times. In some examples, to reduce the likelihood of the insulation becoming rigid in this compressed state while exposed to the cool temperatures of the refrigerated area, the seal 134 includes heat tape 330 (FIG. 3) to heat the air within the tubular structure of the seal 134 and the insulation 322. In this manner, the insulation will maintain its resilience to properly bias the flexible sheet 144 outward and into the path of the door panels 102, 104 whenever the panels are moved to the fully open position.

In some examples, vertical portions of the seal 134 (along the lateral edges 136) form miter joints with a horizontal portion of the seal 134 (along the upper edge 138) such that the seal 134 defines a tubular structure extending around the entire doorway 106 along the wall 108. In some examples, a cap 146 closes off the end or bottom 148 of the seal 134. In some such examples, the cap 146 is abutting and/or otherwise sealingly engaged with the floor to block air from passing beneath the seal 134. In some examples, the bottom 148 of the seal 134 may not be closed off with a cap 146 but directly abutting and/or otherwise sealingly engaged with the floor without the cap 146. In either case, in some examples, the bottom of the seal 134 includes an opening through which a wire may pass to electrically couple the heat tape 330 to a power source 150.

FIG. 3 illustrates a cross-sectional view of the example seal 134 in a compressed state when the door panel 102 is in a closed position (as shown in FIG. 1). By contrast, FIG. 4 illustrates a cross-sectional view of the example seal 134 in an expanded state when the door panel 102 is in a fully opened position (as shown in FIG. 2). In the illustrated example, the seal 134 includes the flexible sheet 144 coupled to a wall mount 302 at the first and second edges 140, 142 of the flexible sheet 144. As shown in the illustrated example, the first edge 140 is spaced apart from the second edge 142 such that the flexible sheet 144 forms a generally tubular structure with the wall mount 302. In some examples, the edges 140, 142 have corresponding keder edges 304, 306 to couple the flexible sheet 144 to the wall mount 302. While the keder edges 304, 306, of the illustrated example, are shown as separate components to the flexible sheet 144, in other examples, the keder edges 304, 306 may be integral with the flexible sheet 144.

In the illustrated example, the wall mount 302 includes a first mounting rail 308 to secure the first edge 140 of the flexible sheet 144 and a second mounting rail 310 to secure the second edge 142 of the flexible sheet 144. In some examples, the first and second mounting rails 308, 310 are formed of extruded aluminum or fiberglass. In the illustrated example, the second mounting rail 310 includes an L-bracket 312 and a separate keder track 314 to facilitate mounting to the wall 108. However, in some examples, the second mounting rail 310 is made of a unitary piece. In the illustrated example, the second mounting rail 310 is fastened directly to the wall 108 (e.g., via the L-bracket 312). By contrast, the first mounting rail 308 of the illustrated example is not directly attached to the wall 108 but is attached to the second mounting rail 310 via a connecting block 316. The connecting block 316 serves to rigidly couple the first mounting rail 308 to the second mounting rail 310 while keeping the first mounting rail spaced apart from the second mounting rail 310. In some examples, the connecting block 316 is formed of a material that is less thermally conductive than the material of the first and second mounting rails 308, 310. As a result, the connecting block 316 provides a thermal break between the mounting rails 308, 310 to reduce heat transfer from one side of the seal 134 to the other side via thermal conduction through the wall mount 302.

For example, the first mounting rail 308 may be exposed to a first area 318 corresponding to a refrigerated environment (e.g., a freezer room), while the second mounting rail 310 is exposed to a second area 320 corresponding to an environment with a warmer temperature than the first area 318. Although the cold air temperature of the first area 318 may result in the first mounting rail 308 having a lower temperature, the connecting block 316 (made of a thermally insulative material) reduces heat transfer between the mounting rails 308, 310. As a result, the relatively cooler temperature of the first area 318 may be maintained more efficiently because there will be less heat loss than if the wall mount 302 was made of a unitary material that would allow heat to pass between the first and second areas 318, 320 via thermal conduction. In some examples, the first mounting rail 308 is directly fastened to the wall 108 independently of the second mounting rail 310. In some such examples, the first and second mounting rails 308 are spaced apart such that the connecting block 316 may be excluded.

As shown in the illustrated example, an inner surface of the flexible sheet 144 is lined with insulation 322. In some examples, the insulation is rubber foam, ethylene propylene diene monomer (EPDM) rubber, or other closed cell foam. In some examples, the insulation 322 is bonded to the flexible sheet 144 with an adhesive. In the illustrated example, the insulation 322 is sufficiently stiff to exert an outward biasing force on the flexible sheet 144 to cause the flexible sheet to bulge outward and away from the wall 108 and wall mount 302. More particularly, as shown in the illustrated examples, the flexible sheet 144 is biased away from the wall 108 to sealingly engage with the door panel 102 when the panel is in front of the seal 134 (e.g., when the door panel is in a closed position as shown in FIGS. 1 and 3). Further, when the door panel 102 is not in front of the seal (e.g., when the panel is in the fully open position as shown in FIGS. 2 and 4), the flexible sheet 144 is biased into a path 324 of the door panel 102. Thus, in some examples, the seal 134 is in a compressed state when sealingly engaging the door panel 102 and in an expanded state when the door panel 102 is clear of the seal 134.

In some examples, the insulation 322 is resilient to urge the flexible sheet 144 toward the expanded state after being confined to the compressed state. As a result, each time the door panel 102 opens, the insulation 322 will bias the flexible sheet 144 towards the expanded state to then contact the door panel 102 upon its closing again. In this manner, the flexible sheet 144 sealingly engages the door panel 102 each time it closes to reduce the likelihood of air leaking between the first and second areas 318, 320. In some examples, the size of the seal 134 in the expanded shape is configured to extend into the path 324 of the door panel 102 to account for potential variation in the position of the door panel 102 relative to the wall 108.

The outwardly biased flexible sheet 144 and insulation 322 defines an enclosed area or internal cavity 326 within the tubular structure of the seal 134. As shown in the illustrated examples, the insulation 322 extends substantially between the first edge 140 of the flexible sheet 144 and the second edge 142 of the flexible sheet 144. In this manner, the insulation 322 serves to insulate the air within the cavity 326 from the surrounding areas 318, 320. In some examples, the seal 134 includes an insulation block 328 positioned against the wall mount 302 (including the first mounting rail 308, the second mounting rail 310, and the connecting block 316) to separate the air within the cavity 326 from the wall 108 and the components of the wall mount 302, which may be cold due to exposure to the cold temperatures of the first area 318. In some examples, the insulation block 328 is formed of the same material as the insulation 322 lining the flexible sheet 144. In some examples the insulation block 328 is formed of the same material as the connecting block 316. In some examples, the connecting block 316 is integrally formed with the insulation block 328. In some examples, the insulation 322 is in contact with the insulation block 328 such that the air within the cavity 326 is enclosed by insulative material.

The doors to a cold-storage or other refrigerated room are typically kept closed most of the time to maintain the desired temperature. As a result, in such examples, the seal 134 is likely to be in the compressed state (pressed against the surface of the closed door panel 102) most of the time. Although the insulation 322 may be resilient under normal temperature environments (e.g., room temperature), when exposed to the much cooler temperatures of a refrigerated room, there is the possibility of the insulation setting and becoming stiff That is, at low temperatures, the insulation 322 may harden into position in the compressed state such that it no longer expands to extend into the path 324 of the door panel 102 when the door panel opens. In such a situation there is the possibility that when the door panel 102 closes again, a proper seal between the flexible sheet 144 of the seal 134 and the door panel 102 may not be achieved. Accordingly, in some examples, the seal 134 includes heat tape 330 disposed along the interior cavity 326 (e.g., on the insulation block 328) to heat the air enclosed therein and the insulation 322 such that the insulation 322 maintains resilience even when exposed to the relatively cold temperatures of a refrigerated area. Furthermore, in some examples, the heat produced by the heat tape 330 reduces the likelihood of frost forming on the seal 134 (on either the inside or on the outside). In some examples, the heat tape 330 is self-regulating heat tape to increase heat output when the temperature decreases and to decrease heat output when the temperature increases. The particular capacity of the heat tape 330 depends on the size of the seal 134 and the environment in which the seal 134 is implemented. In some examples, the heat tape 330 uses 8 watts per foot.

Figure 5:
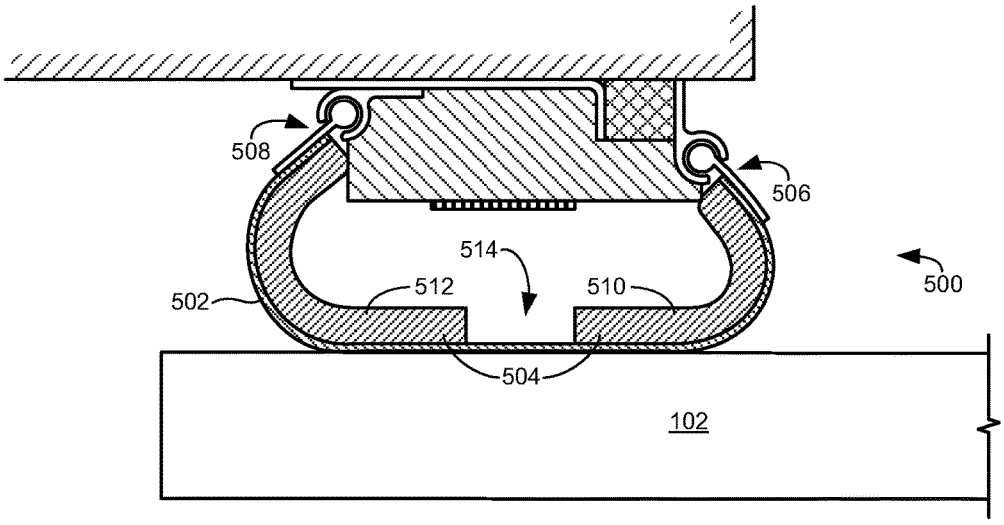
FIGS. 5 and 6 are cross-sectional views of another example seal that may be used in connection with the example door of FIGS. 1 and 2.
Figure 6:
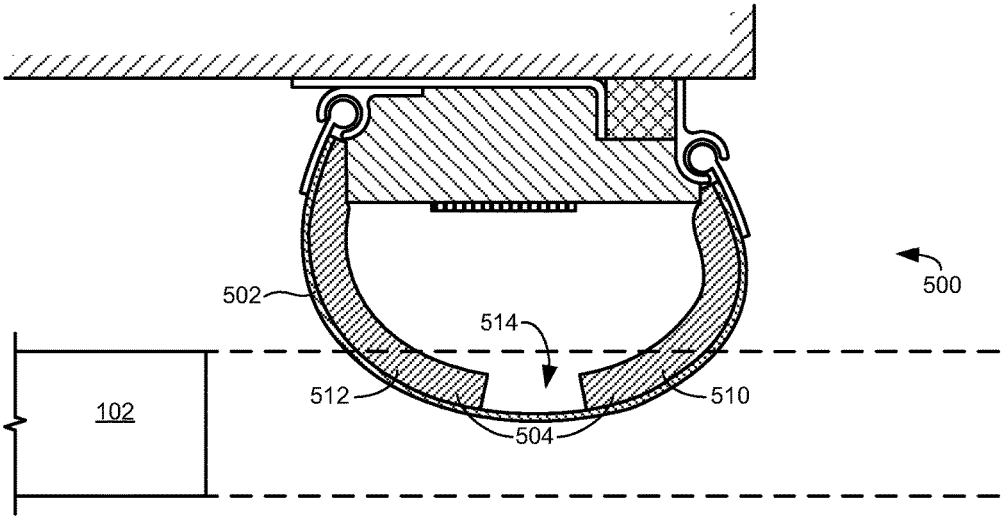

FIGS. 5 and 6 illustrate another example seal 500 similar to the example seal 134 of FIGS. 1-4. However, unlike the seal 134 described above, the example seal 500 of FIGS. 5 and 6 includes a flexible sheet 502 that is lined with insulation 504 that is discontinuous between a first edge 506 of the flexible sheet 502 and a second edge 508 of the flexible sheet 502. More particularly, the insulation 504 includes a first insulation segment 510 adjacent the first edge 506 and a second insulation segment 512 adjacent the second edge 508. In the illustrated example, the first and second insulation segments 510, 512 are spaced apart to define a gap 514 therebetween. In other examples, the first insulation segment 510 may be in contact with or abutting the second segment of insulation 512 (e.g., they are separated by a slit). In some examples, the discontinuity in the insulation 504 (either the gap 514 or a slit) reduces the likelihood of the insulation 504 setting in a compressed state (FIG. 5) when subject to cold temperatures such that the insulation 504 is no longer resilient and able to bias the flexible sheet 502 outward toward an expanded state (FIG. 6).

Figure 7:
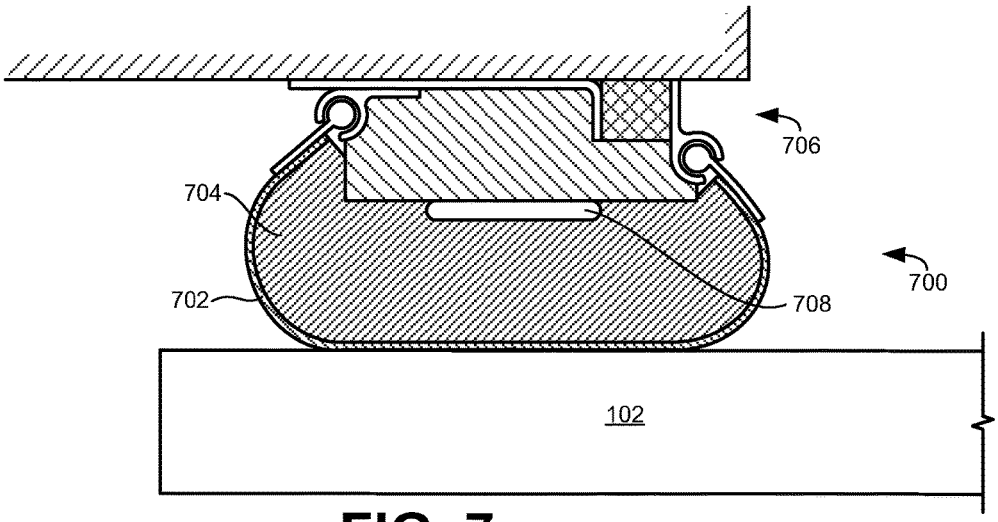
FIGS. 7 and 8 are cross-sectional views of another example seal that may be used in connection with the example door of FIGS. 1 and 2.
Figure 8:
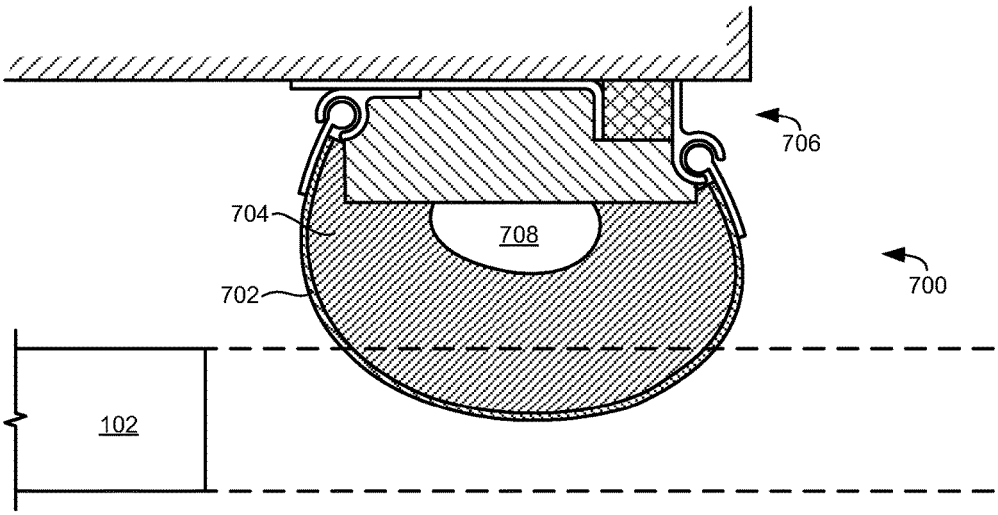

FIGS. 7 and 8 illustrate another example seal 700 similar to the example seal 134 of FIGS. 1-4. However, unlike the seal 134 described above, the example seal 700 of FIGS. 7 and 8 includes a flexible sheet 702 that is lined with insulation 704 that is much thicker than the insulation 322 in the seal 134 of FIGS. 1-4. For instance, in some examples, the insulation 322 in the seal 134 of FIGS. 1-4 has a thickness of ranging from approximately 0.25 inches to 0.5 inches, whereas the insulation 704 in FIGS. 7 and 8 has a thickness ranging from 1 inch to 2 inches. The particular thickness of the insulation may depend upon the size of the seal and/or other relevant factors. In some examples, the insulation 704 substantially fills (e.g., at least 85%) the enclosed area defined by the flexible sheet 702 and a wall mount 706. In some examples, the insulation 704 defines a small cavity 708 of open air to facilitate the compression of the insulation 704 when compressed against the door panel 102. In other examples, there is no cavity of open air within the seal 700. In some examples, unlike the seal 134 of FIGS. 1-4, the seal 700 of FIGS. 7 and 8 does not include heat tape because the insulation 704 is sufficiently thick to avoid setting and becoming rigid without internal heating of the seal 700.

Figure 9:
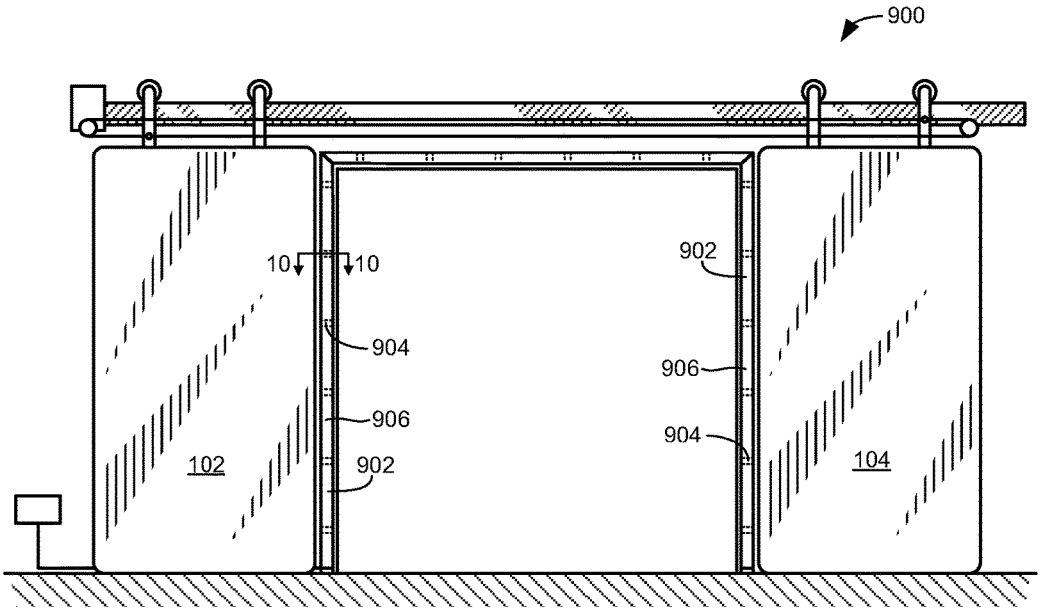
FIG. 9 illustrates another example door implemented in accordance with the teachings of this disclosure.
Figure 10:
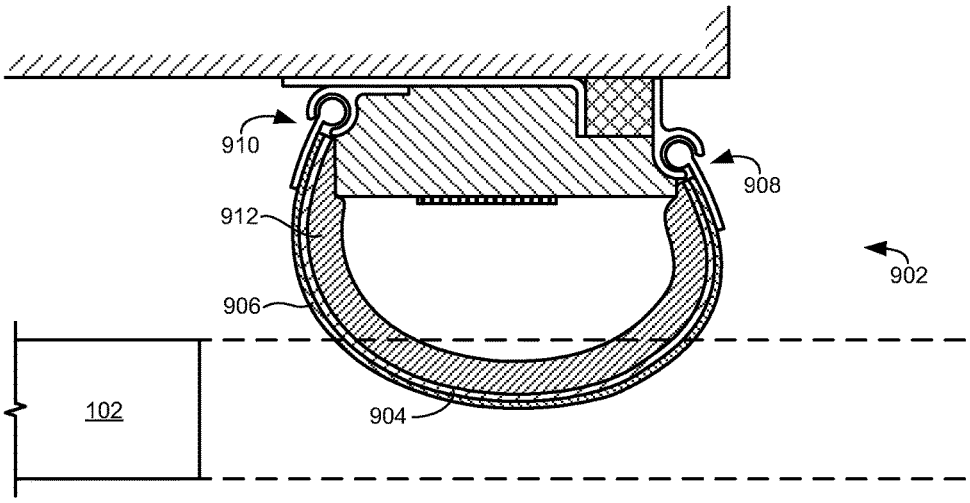
FIG. 10 is a cross-sectional view of the example seal of FIG. 9 taken along line 10-10 of FIG. 9.

FIG. 9 illustrates another example door 900 similar to the example door 100 of FIG. 1. However, unlike the example door 100 of FIG. 1, the example door 900 of FIG. 9 includes a seal 902 that has a plurality of spaced apart stays 904. In some examples, the stays 904 serve to bias a flexible sheet 906 of the seal 902 outwards and into a path of the door panels 102, 104 to maintain sealing engagement with the door panels 102, 104. As shown in the cross-sectional view of FIG. 10, in some examples, the stays 904 extend along an inner surface of the flexible sheet 906 between first and second edges 908, 910 of the flexible sheet 906. In some examples, the stays 904 provide a biasing force in addition to the resilience of the insulation 912 lining the flexible sheet 906. In some examples, the stays 904 are used in place of the insulation 912 such that the insulation 912 is optional. In some examples, the stays 904 are fiberglass strips bent or arched along the inner surface of the flexible sheet 906. The stays 904 may be of any suitable size and spaced apart at any suitable distance. For example, the stays 904 may be approximately 0.25 inches wide and positioned approximately 12 inches apart along the length of the seal 902. In other examples, the stays 904 may be wider or narrower (e.g., ⅛ inch, 1 inch, etc.) and/or separated at differently spaced intervals (e.g., 6 inches, 2 feet, etc.).

Figure 11:
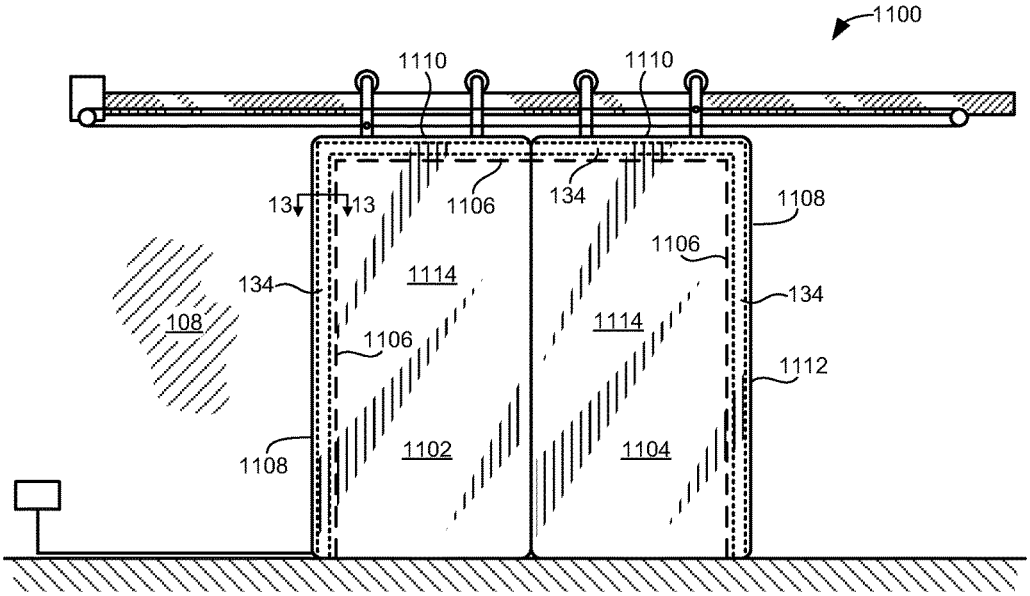
FIG. 11 illustrates another example door implemented in accordance with the teachings of this disclosure with door panels in a closed position.
Figure 12:
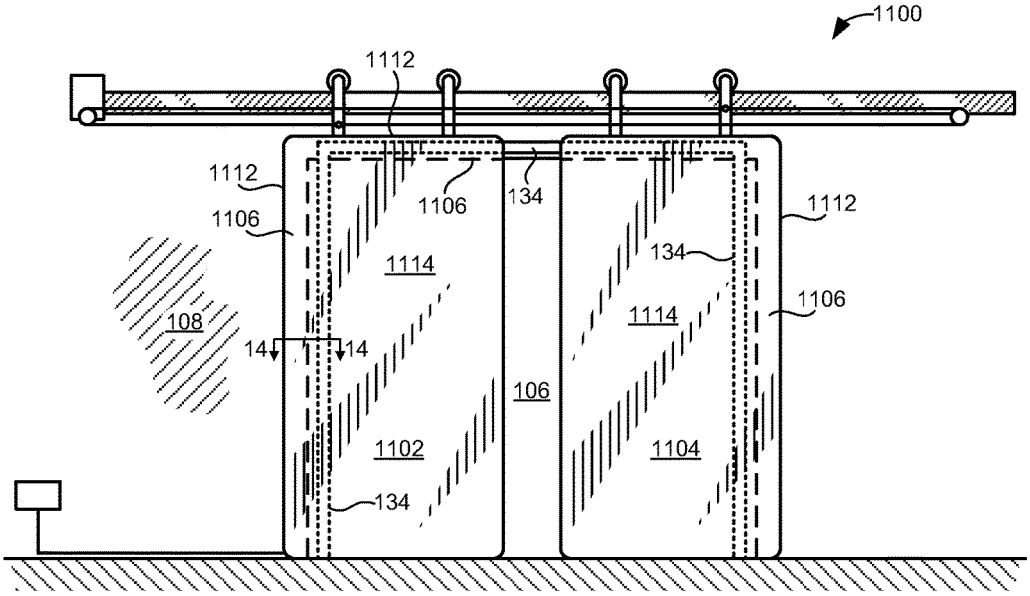
FIG. 12 illustrates the example door of FIG. 11 with the door panels in a partially open position.

FIGS. 11-14 illustrate another example door 1100 that may be implemented in connection with any of the example seals 134, 500, 700, 902 described herein. For purposes of explanation, the example door 1100 is described with respect to the seal 134 described above in connection with FIGS. 1-4. As shown in the illustrated examples, the door 1100 includes two translating door panels 1102, 1104. The door panels 1102, 1104 of FIGS. 11-14 are similar to the door panels 102, 104 of FIGS. 1-4 except that the door panels 1102, 1104 include a protrusion 1106 on the surface of the panels facing towards the seal 134 and the doorway 106. More particularly, as shown in FIG. 11, the protrusion 1106 extends along the outer lateral edge 1108 and top edge 1110 of each panel to align with the seal 134 when the door panels 1102, 1104 are in the closed position.

For purposes of explanation, the portion of the door panels 1102, 1104 where the protrusion 1106 is located (along outer lateral and top edges 1108, 1110) is referred to herein as the outer edge 1112 of the door panels 1102, 1104. The remaining portion of the door panels 1102, 1104 (excluding the outer edge 1112) is referred to herein as the main body 1114 of the door panels. As shown in the illustrated examples of FIGS. 13 and 14, the main body 1114 of the door panels 1102, 1104 have a main body thickness 1116 that is less than an edge thickness 1118 associated with the outer edge 1112 of the door panels 1102, 1104 (e.g., along the outer lateral edge 1108 and top edge 1110 of the panels). In some examples, the main body thickness 1116 ranges from approximately 3 inches to 4 inches while the edge thickness 1118 ranges from approximately 4.5 inches to 5.5 inches (e.g., the protrusion is approximately 1.5 inches thick). In some examples, the protrusion 1106 is integrally made with the door panel 1102. In other examples, the protrusion 1106 may be attached to a door panel that otherwise has a generally consistent thickness. That is, in some examples, existing door panels may be retrofitted with the protrusion 1106 as described herein.

Figure 13:
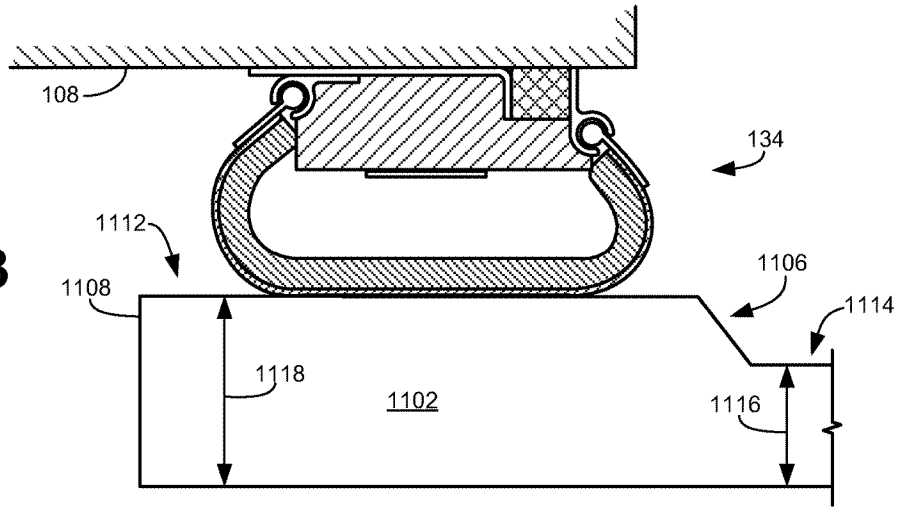
FIG. 13 is a cross-sectional view of the example seal of FIGS. 11 and 12 taken along line 13-13 of FIG. 11.
Figure 14:
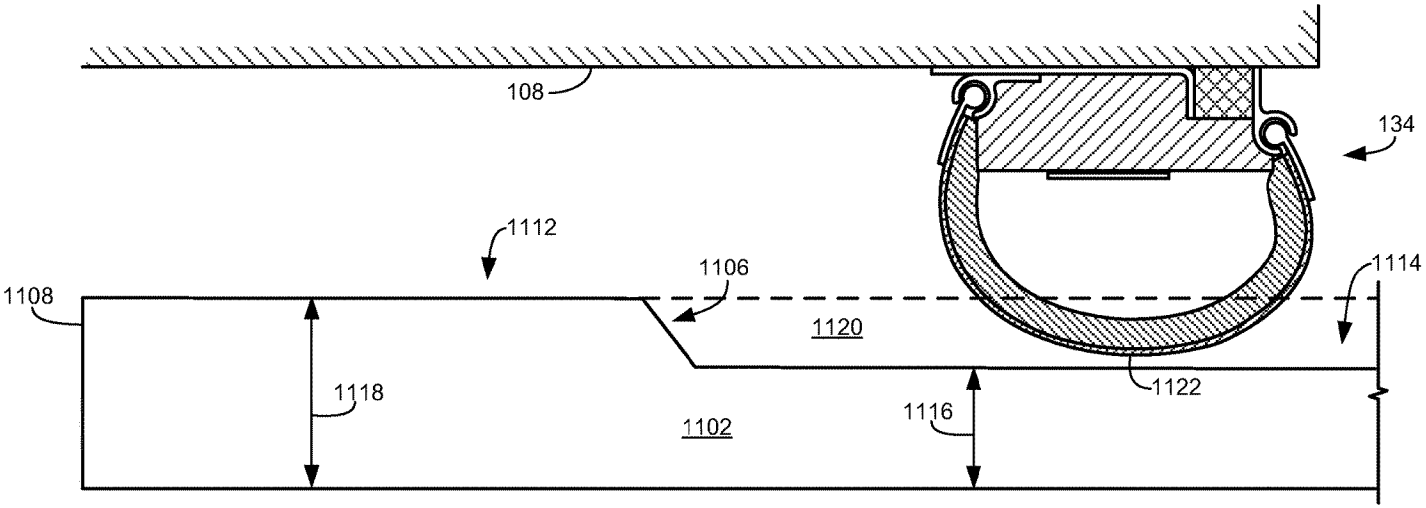
FIG. 14 is a cross-sectional view of the example seal of FIGS. 11 and 12 taken along line 14-14 of FIG. 2.

As shown in the illustrated example of FIG. 14, the boundary of the travel path of the door panel 1102 closest to the seal 134 corresponds to a path 1120 of the protrusion 1106 on the door panel. Thus, when the seal 134 is in an expanded form (FIG. 14), the seal 134 extends into the path 1120 of the protrusion 1106 to ensure sealing engagement with the door panel 1102 (at the protrusion 1106) when the door panel 1102 is in the closed position (FIG. 13). However, in some examples, the seal 134 in its expanded shape does not extend out sufficiently to contact the main body 1114 of the door panel 1102. In other words, an outermost extremity 1122 of the seal 134 in the expanded shape remains spaced apart from the main body 1114 when the door panel 1102 is in a partially or fully opened position. In this manner, the vertical portions of the seal 134 experience less wear because the door panels 1102, 1104 contact the vertical portions of the seal 134 during only a brief portion of the movement of the door panels 1102, 1104 between the closed position and a fully open position.

The particular size and/or shape of the protrusion 1106 may be suitably adapted to the configuration of the seal 134 and/or the position of the door panels 1102, 1104 relative to the wall 108. In some examples, the protrusion 1106 is configured with a width approximately the same as or slightly larger than (e.g., twice the size of) a width of the seal 134 to ensure proper sealing engagement. Further, in some examples, the protrusion 1106 is configured such that the difference in the distance that the seal 134 extends from the wall 108 between the compressed state (FIG. 13) and the expanded state (FIG. 14) is less than the thickness of the protrusion to provide a gap or space between the outermost extremity 1122 of the seal 134 and the main body 1114 of the seal 134. For example, where the seal 134 is approximately 4 inches wide, the protrusion 1106 may be approximately 8 inches wide with a thickness of approximately 1.5 inches. In some such examples, the distance that the seal 134 extends outward away from the wall 108 when in the expanded state (FIG. 14) relative to the compressed state (FIG. 13) is less than 1.5 inches (e.g., 1 inch). For example, the distance of the outermost extremity 1122 of the seal 134 from the wall 108 in the expanded state may be approximately 3 inches while the distance between the wall 108 and the protrusion 106 (i.e., the distance of the outermost extremity 1122 of the seal 134 from the wall 108 when in the compressed state) is approximately 2 inches.

From the foregoing, it will appreciate that the above disclosed methods, apparatus and articles of manufacture enable the effective sealing of doors to a refrigerated room by lining a flexible sheet with resilient insulation to bias the flexible sheet into engagement with door panels in a closed position. Example seals disclosed herein include heat tape to heat the insulation so that it maintains its resilience or flexibility even when compressed and subject to the cold temperature environments of a refrigerated room for extended periods of times. Furthermore, example seals disclosed herein include a wall mount made of spaced apart mounting rails coupled via a thermally insulative connecting block to reduce heat conduction from a warm side of the seal to a cold side of the seal, thereby reducing the cooling load on the refrigerated room.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A seal for a door, comprising:

a first mounting rail;

a second mounting rail spaced apart from the first mounting rail;

a flexible sheet extending between the first mounting rail and the second mounting rail, the flexible sheet to be biased away from the first and second mounting rails to sealingly engage the door when the door is in a closed position; and a connecting block to connect the first mounting rail to the second mounting rail, the connecting block less thermally conductive than either the first or second mounting rails; and stays to bias the flexible sheet away from the first and second mounting rails.

2. The seal of claim 1, further including an insulation block extending between the first and second mounting rails, the flexible sheet and the insulation block to define an enclosed area within the seal.

3. The seal of claim 2, further including self-regulating heat tape attached to the insulation block to heat the enclosed area.

4. The seal of claim 2, further including resilient insulation disposed within the enclosed area to bias the flexible sheet away from the first and second mounting rails.

5. The seal of claim 4, wherein the insulation substantially fills the enclosed area.

6. The seal of claim 4, wherein the resilient insulation is a foam lining that extends continuously between the first mounting rail and the second mounting rail.

7. The seal of claim 1, further including resilient insulation to line an inside surface of the flexible sheet, the insulation to bias the flexible sheet away from the first and second mounting rails.

8. The seal of claim 7, wherein the insulation is to be a unitarily formed material substantially extending between the first mounting rail and the second mounting rail.

9. The seal of claim 1, wherein the second mounting rail is to be directly fastened to a wall and the first mounting rail is to be indirectly fastened to the wall via the connecting block and the second mounting rail.

10. The seal of claim 1, wherein the flexible sheet is to be spaced apart from a main body of the door when the door is in a partially open position.

11. A seal for a door, comprising:

a first mounting rail;

a second mounting rail spaced apart from the first mounting rail; and a flexible sheet extending between the first mounting rail and the second mounting rail, the flexible sheet to be biased away from the first and second mounting rails to sealingly engage the door when the door is in a closed position, wherein the flexible sheet is coupled to the first mounting rail via a first keder edge and the flexible sheet is coupled to the second mounting rail via a second keder edge.

12. The seal of claim 11, further including heat tape disposed within an internal cavity defined by the flexible sheet.

13. A seal for a door, comprising:

a first mounting rail;

a second mounting rail spaced apart from the first mounting rail; and a flexible sheet extending between the first mounting rail and the second mounting rail, the flexible sheet to be biased away from the first and second mounting rails to sealingly engage the door when the door is in a closed position; and resilient insulation to line an inside surface of the flexible sheet, the insulation to bias the flexible sheet away from the first and second mounting rails, wherein the insulation includes a first insulation segment adjacent the first mounting rail and a second insulation segment adjacent the second mounting rail, the first insulation segment separate from the second insulation segment.

14. The seal of claim 13, wherein the first insulation segment and the second insulation segment abut one another.

15. The seal of claim 13, wherein the first insulation segment is spaced apart from the second insulation segment to define a gap.

16. The seal of claim 13, further including a connecting block to connect the first and second mounting rails, the connecting block to maintain separation between the first mounting rail and the second mounting rail.

17. The seal of claim 16, further including an insulation block disposed adjacent the first mounting rail, the second mounting rail, and the connecting block to separate air within an enclosed area defined by the flexible sheet from the first mounting rail, the second mounting rail, and the connecting block.

18. The seal of claim 17, further including self-regulating heat tape within the enclosed area to heat the enclosed area.

19. The seal of claim 18, wherein the heat tape is affixed to the insulation block.

20. The seal of claim 13, wherein the insulation is to bias the flexible sheet into a path of a door panel of the door to sealingly engage the door panel when the door panel is in a closed position, the path of the door panel defined by a protrusion along an outer edge of the door panel, the protrusion protruding from a surface of a main body of the door panel towards a wall on which the first and second mounting rails are to be mounted, an outermost extremity of the flexible sheet when biased into the path of the door panel to remain spaced apart from the surface of the main body when the door panel is in a partially open position.

21. The seal of claim 13, wherein the second mounting rail is to be directly fastened to a wall adjacent the door and the first mounting rail is to be indirectly fastened to the wall via the connecting block and the second mounting rail.

22. A seal for a door, comprising:

a wall mount;

a flexible sheet having a first edge to be secured to the wall mount and a second edge to be secured to the wall mount, the flexible sheet and the wall mount to define an internal cavity;

a foam lining affixed to an inner surface of the flexible sheet, the foam lining to bias the flexible sheet away from the wall mount to sealingly engage the door when the door is in a closed position, wherein the foam lining includes a discontinuity between the first edge of the flexible sheet and the second edge of the flexible sheet; and heat tape disposed within the internal cavity to heat the internal cavity and the foam lining.

23. The seal of claim 22, wherein the discontinuity corresponds to a gap between separate segments of the foam lining.

24. The seal of claim 22, wherein the wall mount includes a first mounting rail, a second mounting rail, and a connecting block that separates the first and second mounting rails.

* * * * *